US005815996A

United States Patent [19]

Granger

[11] Patent Number: 5,815,996

[45] Date of Patent: Oct. 6, 1998

[54] INTERIOR-MOUNTED COVER FOR ROOF VENTILATOR

[76] Inventor: Timothy L. Granger, 2222 7th St., Galena Park, Tex. 77547

[21] Appl. No.: 792,878

[22] Filed: Jan. 31, 1997

[51] Int. Cl.[6] ..... E06B 3/26

[52] U.S. Cl. ..... 52/202; 52/198; 52/199; 52/203; 52/200; 49/400; 49/475.1; 454/900

[58] Field of Search ..... 52/198, 199, 202, 52/203, 200; 454/900, 365, 366; 49/400, 475.1

[56] References Cited

U.S. PATENT DOCUMENTS

| | | | |
|---|---|---|---|
| 3,624,963 | 12/1971 | Osteen et al. | 49/400 X |
| 3,934,383 | 1/1976 | Perry et al. | 52/199 X |
| 4,608,780 | 9/1986 | Van Noy | 49/400 |
| 5,315,798 | 5/1994 | Zarwell | 49/400 X |
| 5,440,843 | 8/1995 | Langenhorst | 52/220.8 X |

*Primary Examiner*—Creighton Smith
*Assistant Examiner*—W. Glenn Edwards
*Attorney, Agent, or Firm*—Gunn & Associates, P.C.

[57] ABSTRACT

A ventilation opening closure to close off a standard opening in a support structure such as a roof or wall includes a base and a cover plate. The base comprises a base ring, a seal ring between the base ring and the support structure, and a bevel-shaped seal ring to align and seal the cover plate with the base ring. The closure may include a pair of complementary hinges that the closure can be opened to the right or to the left. Alternatively, rather that the second hinge, the closure may include a latch means to more quickly shut the closure.

11 Claims, 3 Drawing Sheets

FIG.3a
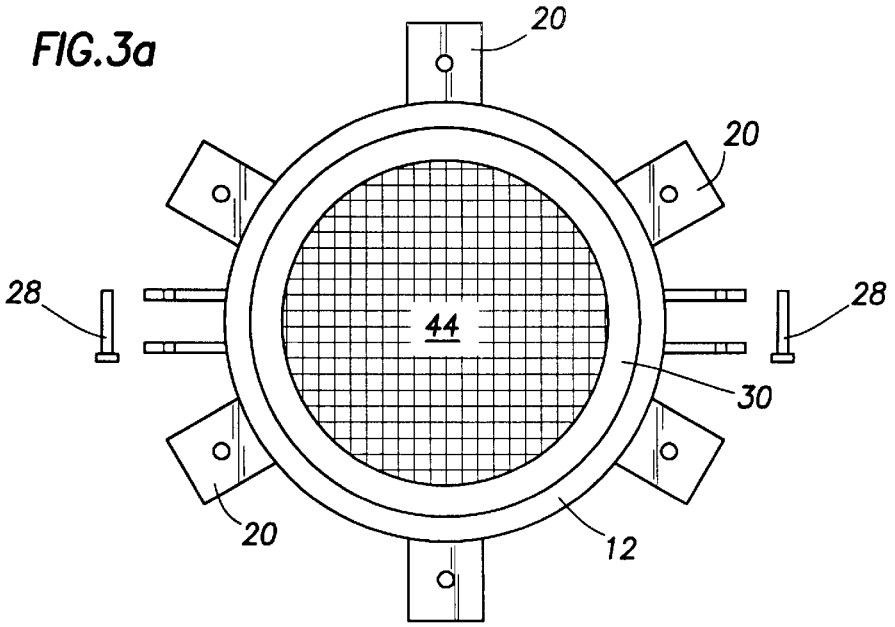
FIG.3b
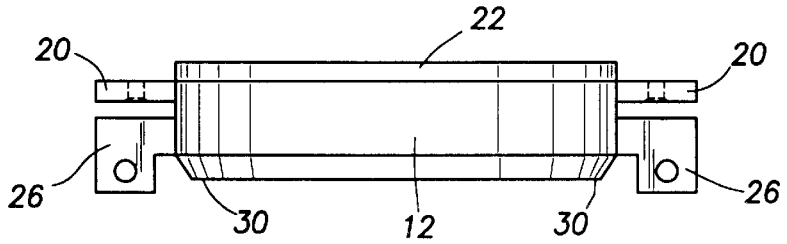
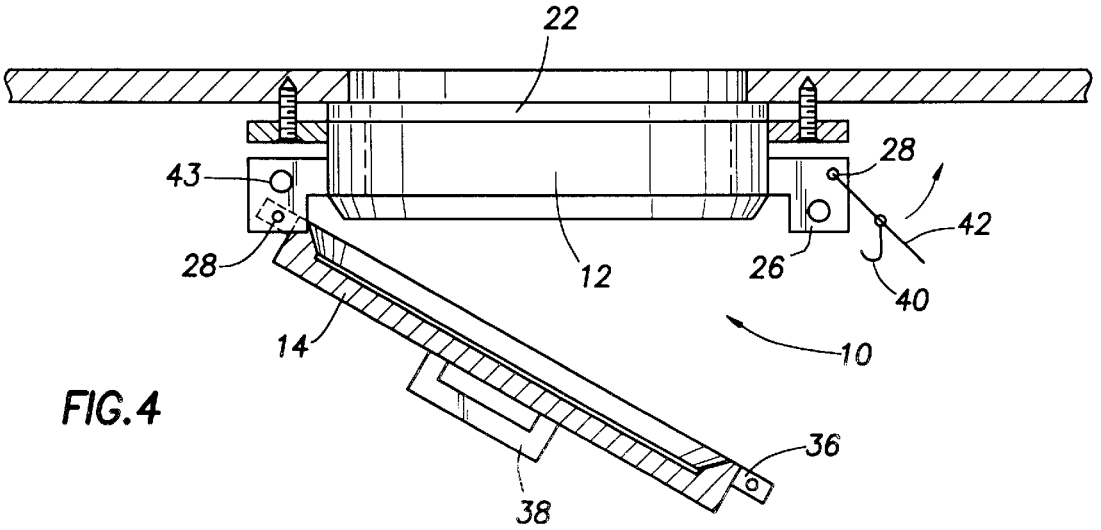
FIG.4

INTERIOR-MOUNTED COVER FOR ROOF VENTILATOR

FIELD OF THE INVENTION

The present invention relates generally to the field of roof-mounted ventilators and, more particularly, to an interior seal for such a ventilator.

BACKGROUND OF THE INVENTION

A single-family dwelling commonly has a ventilator mounted on the roof to permit air-flow into and out of the dwelling, usually from an attic or other space. The ventilator opening often has a roof-top wind turbine installed dover it and there is commonly a screen across the opening to keep debris from falling into the ventilated space.

In inclement weather, it is desirable to close off the ventilator. For example, during heavy rain or high wind, one may wish to isolate the inside space from the outside. Without such a closure means, water and extreme cold can enter the ventilated space. In cold climates, it is preferable to provide access to the closure means from inside the house, so that the homeowner does not have to get out into the elements and onto the roof of the house to close off the ventilator. It is also preferable that the closure be simple and inexpensive, as well as easy to install.

The need to close off ventilation openings has been long recognized in the art. However, most closure means have been included as a part of the ventilation apparatus and are not easily adaptable to a previously installed ventilator as a retrofit. Other closure means, although they may be modified to serve as a retrofit, are inflexible in that they are often difficult to fit within the interior structures on which they are to be installed.

Thus, there remains a need for a simple and inexpensive ventilation closure that can be installed on any standard ventilation opening on a dwelling. The closure should be easy to operate in a variety of interior structures, and provide options to the user on modes of operation.

SUMMARY OF THE INVENTION

The present invention addresses these and other shortcomings of the prior art. The closure of the present invention comprises primarily a base and a cover plate. The base describes a solid ring, mounted to the underside of a ventilation opening with a sealing gasket between the base and the structure to which it is mounted, such as a roof structure. The base ring is sufficiently wide to accommodate a number of standard size ventilation openings. The base may be mounted to the structure with a plurality of wood screws or other appropriate mounting means.

The base further includes a bevel-shaped seal ring on its underside. This bevel-shaped seal ring provides positive closure when the cover plate is secured, and further provides alignment of the cover plate to the base. This feature eliminates the need for close tolerances in the manufacture of the structure of the present invention.

The cover plate is preferably mounted to the base by a pin for a hinge joint. A similar pin/hinge joint is provided on the opposite side of the structure so that the closure is adapted to be operated from either side. Alternatively or in addition, a snap-hinge closure may be provided to secure one side of the cover plate to the base.

The cover plate includes a frustoconical interior shape to mate with the bevel-shaped seal ring. This completes the sealing and alignment feature of the closure. The cover plate may also be provided with a handle on the underside of the plate to facilitate opening the cover plate after being closed for an extended period of time.

These and other features of the present invention will be apparent to those of skill in the art from a review of the following detailed description along with the accompanying drawings.

BRIEF DESCRIPTION OF THE DRAWINGS

FIG. 3*a* is a plan view of a seal ring mount to which the cover plate of FIG. 2*a* may be coupled in the present invention.

FIG. 3*b* is a side view of the seal ring mount of FIG. 3*a*.

FIG. 4 is a side, partial-sectional view of the ventilation closure of the present invention, including a snap-hinge embodiment of the closure.

DETAILED DESCRIPTION OF A PREFERRED EMBODIMENT

Figure 1:
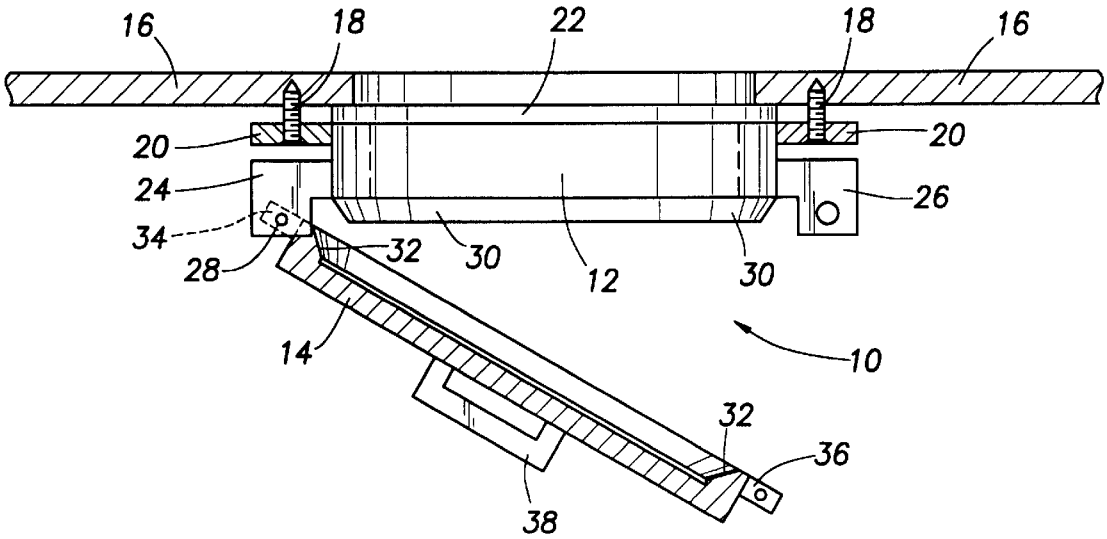
FIG. 1 is a side, partial-sectional view of the ventilation closure of the present invention.

Referring now to the drawing figures, FIG. 1 depicts a ventilation closure 10 of the present invention. The closure 10 comprises primarily a base including a base ring 12 and a cover plate 14. The base ring 12 is mounted to a support structure 16, such as a roof or other structure, by a plurality of screws 18, or other appropriate means, through flange members 20. Between the base ring 12 and the support structure 16 is a seal ring 22, preferably of a compressible polymeric material to provide a water-tight seal around the base ring 12.

Extending from the base ring 12 is a first hinge mount 24 and a second or complementary hinge mount 26. Each hinge mount 24 and 26 preferably comprises a pair of flat plates, as shown in FIGS. 1 and 3*a*. Each flat plate has a hole therethrough to receive a pin 28. The pins 28 serve to secure the cover plate 14 to the base ring 12.

The base ring further includes a seal ring 30. The seal ring is also preferably made of a compressible polymeric material to positively seal the cover plate over the base ring. The seal ring 30 preferably has a bevel-like cross section which provides enhanced sealing area and, more particularly, aligns the cover plate 14 with the base ring in the closed position, as described below.

The various components of the base described thus far (except for the screws) are preferably made as a unitary structure for ease of installation. For ease of manufacture, the base ring 12 may be made of a durable molded plastic, such as by injection molding, and the seal ring 22 and the bevel-seal ring 30 glued to it. The various parts of the closure may also be made of any other appropriate material that will endure in the anticipated environment, such as aluminum or other corrosion resistant material.

Figure 1A:
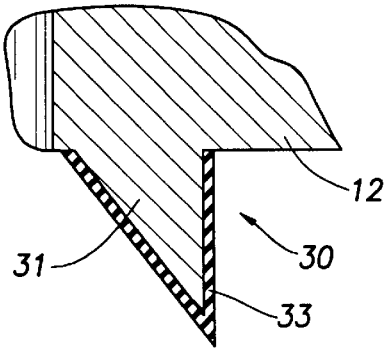
FIG. 1*a* depicts a partial section view of a detail of a bevel-shaped seal of the present invention.
Figure 2A:
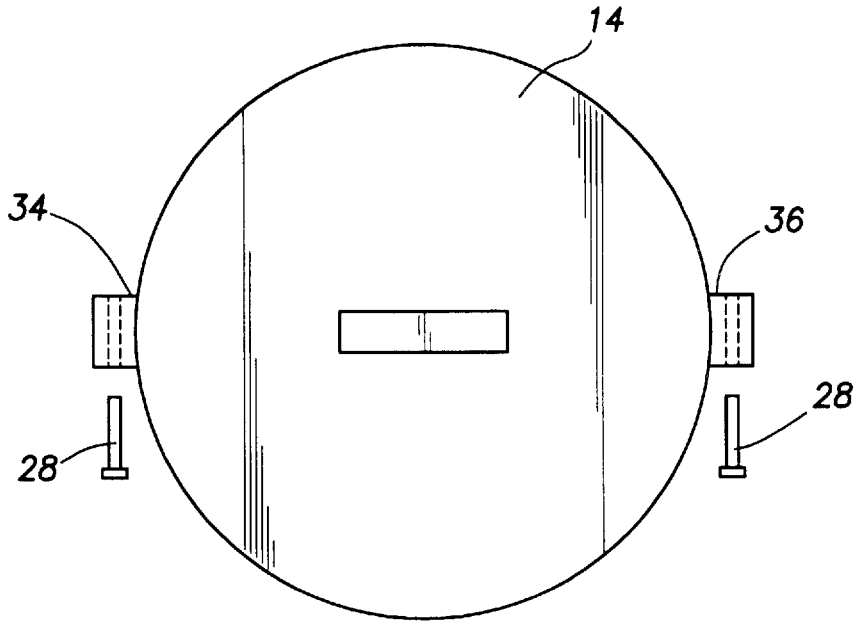
FIG. 2*a* is a plan view of a cover plate that forms a part of the present invention.
Figure 2B:
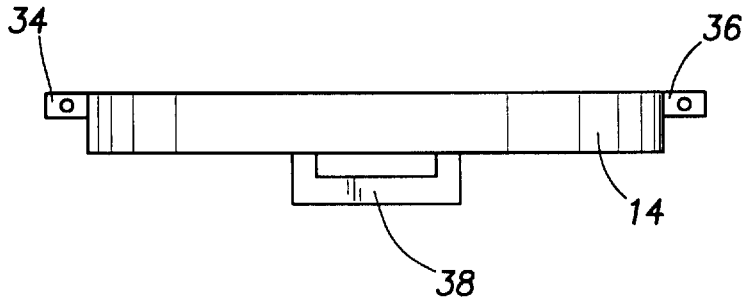
FIGS. 2*b* and 2*c* depict side and section views, respectively, of the cover plate of FIG. 2*a*.
Figure 2C:
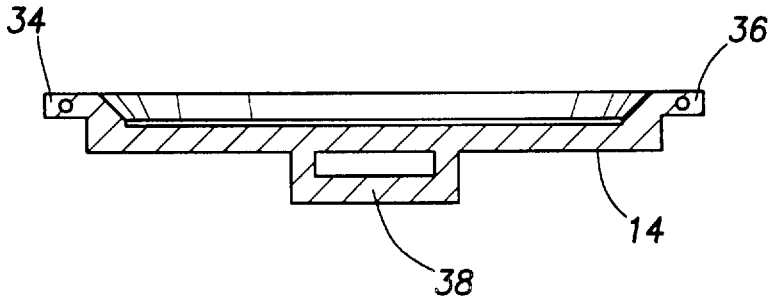

The unitary structure feature of the base is shown in further detail in FIG. 1*a*. In this alternative preferred embodiment of the bevel-seal ring 30, a bevel-shaped projection 31 from the base 12 is covered with a relatively thin seal material 33, which is itself made of a compressible polymeric material. This alternative structure provides the advantage of a solid structure backing to receive the compression and alignment forces to align and seal the cover plate.

Mounted to the base ring 12 by the pins 28 is the cover plate 14. The cover plate 14 includes a frustoconical seat 32 that seals in abutting engagement with the bevel-seal ring 30 when the plate is closed against the base ring 12. Projecting from the cover plate is a first hinge plate 34 and a second or complementary hinge plate 36, which mate with the first and complementary hinge mounts 24 and 26, respectively. The cover plate also preferably includes a handle 38 for opening the cover plate if it sticks to the bevel-seal ring 30.

FIG. 4 depicts an additional optional feature of the present invention. As described so far, the base ring 12 and the cover plate 14 are secured together with a pair of pins 28 and hinges on either side. Either one pin 28 or the other may be removed to open the closure, so that the closure can swing to the right or to the left, as desired. This feature is advantageous where the closure may be installed in a variety of interior structures. This feature is retained if the latching mechanism of FIG. 4 is included. In this case, a latch means 40 is hingedly coupled to a latch handle 42 and the latch handle 42 is mounted to the base ring 12 with a pine 28. A pin mount 43 is also provided so that the latch means 40 can be mounted on the opposite side of the closure. Those of skill in the art will quickly recognize equivalent securing mechanisms that serve to shut the cover plate 14 to the base ring 12. In any case, this feature provides even more rapid closure since the pin 28 need not be inserted to secure the hinge plate 36 to the hinge mount 26.

The closure of the present invention may further include a screen 44 (FIG. 3*a*) to keep debris from falling through the opening in the structure to be closed by the closure 10.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A ventilation opening closure to close off an opening in a support structure, the closure comprising:

a. a base including:
   i. a base ring;
   ii. a first seal ring to seal between the base ring and the support structure through which the ventilation opening penetrates;
   iii. a second seal ring on the base ring opposite the first seal ring;

b. a cover plate having a seat to mate with the second seal ring; and c. a first hinge coupling the base to the cover plate.

2. The closure of claim 1 further comprising a plurality of flange members extending from the base ring to provide means for securing the base ring to the support structure.

3. The closure of claim 2, wherein the first hinge includes a first hinge mount extending from the base ring.

4. The closure of claim 3 wherein the base ring, the plurality of flange members, and the first hinge mount are formed as an integral unit.

5. The closure of claim 3, further comprising a second hinge including a second hinge mount extending from the base ring opposite the first hinge mount, so that the first hinge or the second hinge may alternatively couple the base to the cover plate.

6. The closure of claim 1, wherein the second seal ring has a bevel-shaped cross section and the seat of cover plate has a frustoconical shape to mate with the bevel shape of the second seal ring.

7. The closure of claim 6, wherein the second seal ring comprises a bevel-shaped projection molded as an integral part of the base, and wherein the projection is covered with a compressible polymeric material.

8. The closure of claim 1 further comprising a handle on the cover plate.

9. The closure of claim 1, further comprising a latch means opposite the first hinge to securely close the cover plate against the base.

10. A method of closure a ventilation opening through a support structure, the method comprising the steps of:

a. mounting a base around the ventilation opening, the base including:
   i. a base ring;
   ii. a first seal ring to seal between the base ring and the support structure through which the ventilation opening penetrates;
   iii. a second seal ring on the base ring opposite the first seal ring;

b. coupling a cover plate to the base with a first hinge coupling, the cover plate having a seat to mate with the second seal ring; and c. closing the cover plate against the second seal ring and securing the cover plate to the base with a second hinge coupling.

11. A method of closure a ventilation opening through a support structure, the method comprising the steps of:

a. mounting a base around the ventilation opening, the base including:
   i. a base ring;
   ii. a first seal ring to seal between the base ring and the support structure through which the ventilation opening penetrates;
   iii. a second seal ring on the base ring opposite the first seal ring;

b. coupling a cover plate to the base with a hinge coupling, the cover plate having a seat to mate with the second seal ring; and c. closing the cover plate against the second seal ring and securing the cover plate to the base with a latch coupling.

* * * * *